US005258248A

United States Patent [19]

Tokuhashi et al.

[11] Patent Number: 5,258,248

[45] Date of Patent: Nov. 2, 1993

[54] IMAGE DENSITY CONTROL METHOD FOR AN IMAGE FORMING APPARATUS

[75] Inventors: Masaki Tokuhashi, Yokohama; Moriyuki Koike, Kawasaki; Wataru Yasuda, Yokohama; Kouji Ishigaki, Yokohama; Takashi Bisaiji, Yokohama; Chikara Imai, Tokyo, all of Japan

[73] Assignee: Ricoh Company, Ltd., Tokyo, Japan

[21] Appl. No.: 865,660

[22] Filed: Apr. 7, 1992

Related U.S. Application Data

[63] Continuation of Ser. No. 523,021, May 14, 1990, abandoned.

[30] Foreign Application Priority Data

| | | | |
|---|---|---|---|
| Apr. 18, 1989 | [JP] | Japan | 1-96518 |
| Jun. 22, 1989 | [JP] | Japan | 1-160086 |
| Jun. 22, 1989 | [JP] | Japan | 1-160088 |
| Jul. 28, 1989 | [JP] | Japan | 1-193965 |
| Oct. 26, 1989 | [JP] | Japan | 1-278926 |
| Oct. 27, 1989 | [JP] | Japan | 1-280418 |
| Feb. 20, 1990 | [JP] | Japan | 2-39166 |

[51] Int. Cl.[5] ..... G03G 15/08

[52] U.S. Cl. ..... 430/31; 430/30; 355/246; 355/282

[58] Field of Search ..... 430/30, 31, 902, 120; 355/246, 282; 356/404

[56] References Cited

U.S. PATENT DOCUMENTS

| | | | |
|---|---|---|---|
| 4,466,731 | 8/1984 | Champion et al. | 430/30 |
| 4,801,980 | 1/1989 | Arai et al. | 430/30 |
| 4,870,460 | 9/1989 | Harada et al. | 430/30 |

*Primary Examiner*—Marion E. McCamish
*Assistant Examiner*—S. Rosasco
*Attorney, Agent, or Firm*—Oblon, Spivak, McClelland, Maier & Neustadt

[57] ABSTRACT

An image density control method for an image forming apparatus of the type forming a latent image of a document image on a photoconductive element and developing the latent image by a toner to produce a toner image by an electrophotographic procedure. A background pattern whose density is substantially the same as the background density of a document, i.e., a light pattern is illuminated to electrostatically form a latent image thereof on the photoconductive element. The latent image is developed by the toner, and the density of the resultant toner image is optically sensed by an image density sensor. A change in background density due to contamination or an increase in background potential, for example, is detected. Based on the detected change in background density, a quantity of light for imagewise exposure or similar factor dictating the developing ability is corrected, i.e., it is controlled to the light side if the density has been shifted to the dark side. The detection of the background density and the control for correction are effected only when the charge retaining ability of the photoconductive element is stable.

4 Claims, 13 Drawing Sheets

IMAGE DENSITY CONTROL METHOD FOR AN IMAGE FORMING APPARATUS

This application is a continuation of application Ser. No. 07/523,021, filed on May 14, 1990, now abandoned.

BACKGROUND OF THE INVENTION

The present invention relates to an image density control method for an image forming apparatus of the type forming a latent image representative of a document image on a photoconductive element and developing the latent image to produce a toner image by an electrophotographic procedure.

A predominant type of copier or similar image forming apparatus which is implemented by an electrophotographic procedure uses a two component developer, i.e. the mixture of a toner and a carrier. In this type of copier, for example, as the toner is consumed by the repetitive copying process, the toner concentration in the developer is sequentially reduced to in turn lower the density of the resultant toner image. It has been customary, therefore, to supply a supplementary amount of toner to the developer to maintain the density of the developed image constant. In an automatic density control mode, a desired or target image density is associated with the density of a document image which is sensed by a document density sensor. On the other hand, in a manual density control mode, the target density is associated with a particular image notch manually selected on an operation board of the copier. Generally, the first to seventh notches are available with a copier, and the image density decreases with the increase in the notch number. For this kind of image density control, use may be made of a reference density pattern having a reference density, as well known in the art. Specifically, after a latent image representative of the reference density pattern has been formed on a photoconductive element and then developed by the toner, an image density sensor (sometimes referred to as a P sensor) optically senses the density of the resultant toner image. The sensed image density is fed back to a toner supply section of a developing device included in the copier to supply an adequate amount of toner, whereby the image density is maintained constant. This method determines a change in the toner concentration of the developer, i.e., a change in the proportion of the toner to the carrier in terms of a change in the density of the toner image of the reference pattern formed on the photoconductive element, thereby controlling the toner concentration of the developer. While a reflection from the reference density pattern is weak when the toner concentration is high, it becomes intense as the toner density decreases. The reference voltage of the image density sensor or P sensor (surface potential of the photoconductive element developed by an eraser) is usually selected to be 4 V. Then, when the output of the sensor associated with the reference density pattern is higher than 0.5 V which is one-eighth of 4 V and representative of an adequate toner concentration, the toner is determined to be short and, therefore, it is supplied. When the output of the sensor is lower than 0.5 V, the toner is determined to be sufficient and not supplied at all.

Another approach heretofore proposed for image density control is to substantially variable control the developing ability by controlling the total current to be fed to a charger which charges the photoconductive element, the bias voltage for development to be applied to a developing sleeve of the developing device, the voltage to be applied to a lamp of optics, etc. Such an approach is also successful in setting up a desired image notch and disclosed in, for example, Japanese Patent Laid-Open Publication (Kokai) Nos. 61-128269 and 62-280871.

A photoconductive element for use in an electrophotographic copier or similar image forming apparatus is often implemented by $As_2Se_3$ which is an inorganic compound of selenium and a small amount of arsenic. This kind of photoconductive element has the highest sensititivity. The surface of $As_2Se_3$ is coupled with oxygen existing in the air to form an AsO (arsenic oxide) layer, whereby a charge is retained on the photoconductive element. This brings about a problem that the charge retaining ability depends on the condition of the AsO layer. Since an $As_2Se_3$ photoconductive element has hardly any charge retaining ability just after evaporation, it is left in the dark until the charge retaining ability reaches saturation. However, about three to six months are needed for the charge retaining ability to reach saturation. This results in the need for a considerable amount of stock and, therefore, in low productivity. To accelerate such a procedure, i.e., to reduce the period of time over which the photoconductive element should be left in the dark, the element just undergone evaporation may be loaded in a copier, then run with paper sheets for a test for about five to fifteen minutes, and then left in the dark. In practice, however, a copier is put on the market without its photoconductive element being left in the dark for such a sufficient period of time, and it is actually operated before the element attains the expected charge retaining ability. While a serviceman usually tests a new copier for about 5 minutes on the delivery of the machine to a user in order to provide it with as great a charge retaining ability as possible, such a measure is not satisfactory. With a copier having an $As_2Se_3$ photoconductive element, it usually occurs that after the installation of the copier the potential (background potential) of the element increases by about 90 V when about 1,000 copies are produced, i.e., on the lapse of about one to three months. Such an increase in the potential shifts the entire image to the dark side and thereby contaminates the background, often constituting the cause of serviceman call.

Optics built in a copier is generally made up of a glass platen, mirrors, a lens, a dust glass, and an arrangement for cooling the entire optics. When various contaminants such as dust floating in the air, the vapor of oil filling the machine and toner particles deposit on the mirrors and other components of the optics, the transmittance and/or reflectance of the entire optics is lowered to reduce the quantity of light available for imagewise exposure. Especially, the prior art automatic density type control method does not take account of the deposition of such contaminants, i.e., the decrement of the amount of light, so that the entire image is shifted to the dark side. For example, assuming that maintenance cycle a copier is about 80,000 copies, the decrement of the quantity of light corresponds to about 100 V to 200 V in terms of the potential of the photoconductive element. Hence, the density is brought out of the automatic control range, constituting another cause of serviceman call. The shift of the potential of the photoconductive element to the dark side as stated above means that the background potential of the element is changed to contaminate the background.

The conventional image density control of the kind using an image density sensor or P sensor does not give any consideration to the problems discussed above, i.e., it simply controls toner supply in such a manner as to maintain the developing ability constant. Hence, the image density is prevented from matching a selected image notch. This is also true with the alternative approach shown and described in any of the previously mentioned Laid-Open Publications. Specifically, the alternative approach replaces one variable factor capable of changing the developing ability with another variable factor when the former reaches a predetermined value. However, it does not detect a change in the density of the background and, therefore, cannot automatically deal with the background contamination ascribable to the shift of the potential of the photoconductive element to the dark side.

SUMMARY OF THE INVENTION

It is therefore an object of the present invention to provide an image density control method for an image forming apparatus which corrects the deviation of an image notch and thereby allows an image to have an adequate density matching a desired image notch.

It is another object of the present invention to provide an image density control method which corrects the developing ability by detecting a change in the background density of an image, thereby eliminating the contamination of the background.

It is another object of the present invention to provide an image density control method for an image forming apparatus which promotes accurate detection of a change in the background density of an image.

It is another object of the present invention to provide an image density control method for an image forming apparatus which checks the background density for a change and corrects the developing ability only under a condition wherein the developing ability remains stable within a predetermined range, thereby eliminating errors in the detection of background density and developing ability.

It is another object of the present invention to provide an image density control method for an image forming apparatus which eliminates the runaway of the developing ability correction and, yet, frees the correctable width from limitations.

It is another object of the present invention to provide an image density control method which corrects the developing ability in due consideration of the change in the background density of an image due to aging also.

It is another object of the present invention to provide a generally improved image density control method for an image forming apparatus.

An image density control method for an image forming apparatus of the present invention controls a toner image of a document image to a predetermined density by using a reference density pattern having a reference density, electrostatically forming a latent image of the reference density pattern on a photoconductive element, developing the latent image by a developing device which uses a toner-containing two-component developer to form a toner image, optically sensing the density of the toner image, and supplying a toner to the developer in response to the detected density such that the developing ability of the developing device remains constant. The method comprises the steps of electrostatically forming on the photoconductive element a latent image representative of a background pattern whose density corresponds to a background density of a document image, developing the latent image of the background pattern by the developer to form a toner image, optically sensing the density of the toner image associated with the background pattern, detecting a change in the background density in response to the sensed density of the toner image associated with the background pattern, and correcting the developing ability of the developing device in response to the detected change in the background density.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
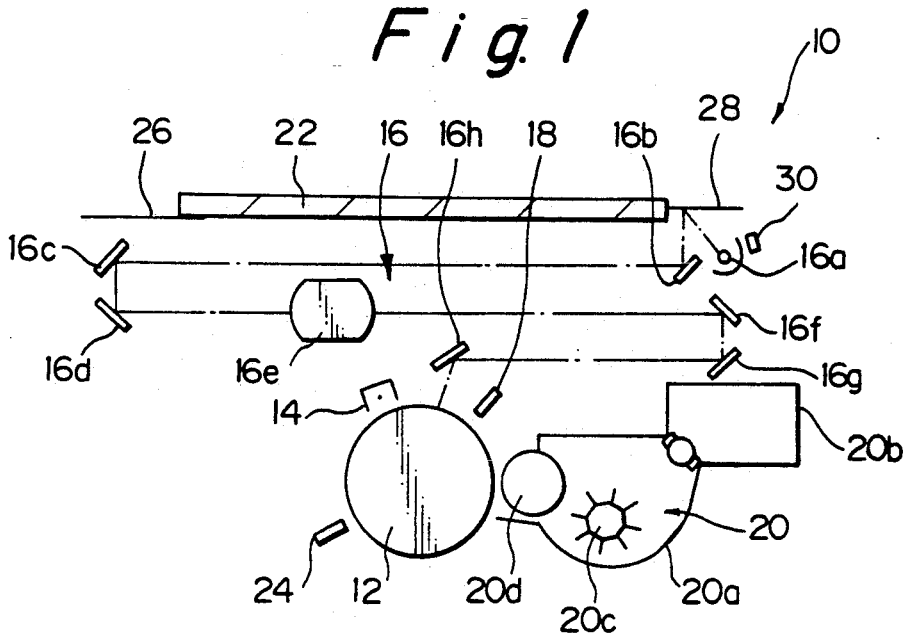
FIG. 1 is a fragmentary section showing an electrophotographic copier belonging to a family of image forming apparatuses to which the present invention is applicable.

To better understand the present invention, a brief reference will be made to the general construction of an image forming apparatus to which the present invention is applicable, shown in FIG. 1. In the figure, the image forming apparatus is implemented as an electrophotographic copier by way of example and generally designated by the reference numeral 10. As shown, the copier 10 has a photoconductive element in the form of a drum 12. The drum 12 may be made of $As_2Se_3$ and have a diameter of 80 millimeters. Arranged around the drum 12 in sequence are a charging device 14 implemented by a charger, an exposing device 16, an eraser 18, and a developing device 16 for executing a predetermined electrophotographic procedure.

The exposing device 17 has a glass platen 22 to be loaded with a document, not shown. While a lamp **16*a* illuminates document laid on the glass platen 22, a reflection or image light from the document is steered by a first mirror 16*b*, a second mirror 16*c* and a third mirror 16*d* to a lens 16*e*. The image light coming out of the lens 16*e* is further steered by a fourth mirror 16*f*, a fifth mirror 16*g* and a sixth mirror 16*h* to the drum 12 to expose the drum 12 imagewise. These components of the exposing device 16 constitute a scanner. The developing device 20 uses a two-component developer, i.e., the mixture of a carrier and a toner. The developing device 20 has a casing 20*a*, a toner tank 20*b*, an agitator 20*c* and a developing sleeve 20*d*. The developing sleeve 20*d* has a diameter of 41 millimeters and adjoins the drum 12**.

A first embodiment of the image density control method in accordance with the present invention will be described hereinafter.

In the first embodiment, the supply of toner is controllably varied in matching relation to the image density on the drum 12 so as to stabilize the developing ability of the developing device 20. In order to implement such variable control, use is made of a reference density pattern 26 having a reference density, and an image density sensor 24 comprised of a reflection type photosensor (sometimes referred to as a P sensor 24 hereinafter). The image density sensor 24 optically senses the density of a toner image formed on the drum 12 and representative of the reference density pattern 26, so that the toner supply is controlled in response to an output of the sensor 24 to maintain the image density constant. The reference density pattern 26 is provided on the leading end of the glass platen 22 and illuminated by the optics 16 before the document. A latent image representative of the reference density pattern 26 is formed on the drum 12 and then developed by the developing device 20 to form, for example, a black solid image pattern on the drum 12. This image pattern is so positioned on the drum 12 as not to overlap with a document image.

Figure 2:
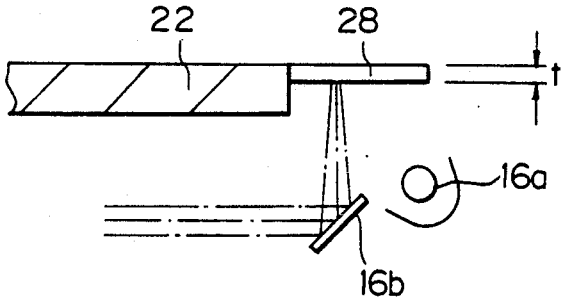
FIG. 2 is an enlarged section of a part of the copier shown in FIG. 1.

In this particular embodiment, a toner image representative of a background pattern is formed on the drum 12 in addition to the toner image, or black solid image, associated with the reference density pattern 16. Specifically, a light pattern 28 is provided on the trailing end of the glass platen 22 to serve as the background pattern, while the optics 16 is constructed to scan the light pattern 28 as well. More specifically, as shown in FIG. 2, the light pattern 28 is located in a position where it is shifted by a dimension t of about 2 millimeters relative to the surface of a document, i.e. the surface of the glass platen 22. Optically, therefore, the light pattern 28 is flush with the surface of the ordinary glass platen 22. This maintains the surface of the glass platen 22 and that of a document equal to each other as to the condensing rate.

Figure 3:
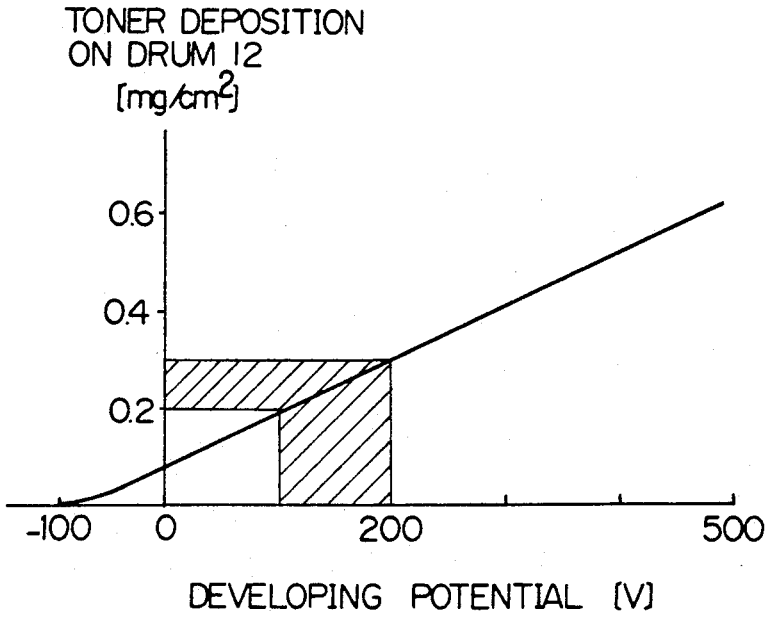
FIG. 3 is a graph indicative of a relationship between the developing potential and the amount of toner deposition on a photoconductive element.

The density of the toner image representative of the light pattern or background pattern 28 is also sensed by the image density sensor or P sensor 24. Basically, it is preferable that the density of the light pattern 28 be equivalent to that of the background, i.e., about 0.08 to 0.1 in order to free the background from contamination. In the illustrative embodiment, however, the density of the light pattern 28 is selected to be slightly higher than that of the background by taking account of the loss ascribable to the glass platen, the irregularity in the level or height of the light pattern 28 and in the density of the pattern itself. Specifically, the light pattern 28 has a density lying in the range of about 0.2 to about 0.3, as indicated by hatching in FIG. 3. Regarding the latent image of such a light pattern 28, should the bias voltage applied to the developing sleeve **20*d* for development be 290 V (associated with the reference density which is the fourth notch), the developing potential would be too low to allow a sufficient amount of toner to deposit on the latent image and, hence, it would be difficult for the P sensor 24 to sense the resultant image. In the light of this, this embodiment lowers the usual bias voltage in the event of development of the light pattern 28, thereby promoting the deposition of toner. Specifically, as shown in FIG. 3, since the latent image representative of the light pattern 28** has a potential of about 150 V to 250 V, the bias voltage for development is selected to be about 50 V to 100 V to insure a developing potential of 100 V to 200 V.

In the illustrative embodiment, the image density control is executed on two different occasions, i.e., when the image is to be adjusted by a serviceman and when the image density is to be corrected, as follows.

First, a reference will be made to FIG. 4 for describing the image density control associated with the serviceman's image adjustment. The processing shown in FIG. 4 will be executed when the image forming apparatus, or copier, 10 is delivered to a user and at the time of periodic maintenance, replacement of the drum 12, etc. After the serviceman has completed image adjustment (step S1), a reference value set mode is set up either automatically or in response to the operation of an exclusive button (step S2). At this instant, in order to maintain the conditions of the drum 12 constant at all times, the copier 10 is operated in a free-run mode over a predetermined period of time (step S3). When the drum 12 is made of $As_2Se_3$, the free-run mode should preferably be continued over a period of time associated with about twenty copies. Thereafter, a latent image of the reference density pattern 26 is electrosatically formed on the drum 12 and then developed by the toner. A reflection from the resultant toner image is sensed by the P sensor 24. This part of the sequence following the step S3 is collectively represented by a step S4, or P sensor mode, in the figure. Whether or not the density Vsp of the toner image sensed by the P sensor 24 lies in a predetermined range relative to a toner supply reference value of 0.5 V, i.e. in the range of $\pm 0.1$ V is determined (step S5). It is to be noted that the reference value of 0.5 V stems from the previously stated relation of $Vsp/Vsg = \frac{1}{8}$. Specifically, when the sensed value Vsp greatly differs from the reference value such as just after or just before the toner supply, it is likely that an error occurs even after the correction. If the sensed value Vsp is greater than the reference value of 0.5 V by more than 0.1 V, i.e., if it is greater than 0.6 V, the toner is supplied. If the sensed value Vsp is lower than 0.5 V by more than 0.1 V, i.e., if it is less than 0.4 V, the black image is automatically formed on the drum 12 in order to control the sensed value Vsp to the target range which is greater than 0.4 V and smaller than 0.6 V. Such a sequence of steps is represented by a step S6 in the figure.

On condition that the sensed image density which is one of the factors dictating the developing ability remains stable within the above-stated particular range, the program enters into operations for detecting a change in background density and correcting the reference value. First, the copier 1 is operated in a free-run mode to rotate the drum 12 over substantially one full rotation (step S7) and to thereby cause the eraser 18 to form a contamination-free region over substantially the entire circumference of the drum 12. Then, the reference voltage Vsg (=4 V) associated with the P sensor 24 is determined as a mean value of input data obtained from a hundred equally divided portions of the surface of the drum 12 (step S8). Subsequently, the scanner including the lamp 16*a* and having been moved to a position just below the light pattern 28 is brought to a stop, and then the lamp 16*a* is turned on to form a latent image representative of the light pattern 28 on the drum 12. This latent image is developed under the application of a bias voltage of 50 V to thereby form a toner image over substantially the entire circumference of the drum 12 (step S9). The density of the toner image associated with the light pattern 28 is also sensed by the P sensor 24, whereby a voltage Vsl representative of the density associated with the light pattern 28 (target being 2 V) is determined on the basis of the data associated with the hundred divided portions of the drum 12 (step S10). The voltage Vsl is divided by the voltage Vsg, and the resultant voltage Vsl/Vsg is written to a memory as a correction reference value for the P sensor 24 (step S11). Also written to the memory is the initial value of a voltage V1 which is applied to the lamp 16*a* (step S12). In this manner, the reference values which will be used for the next correction are set while the developing ability remains stable within the predetermined range.

The density control to be effected at the time of image density correction will be described with reference to FIG. 5. In this particular embodiment, whether or not two hours of suspension has expired after the rise of the fixing temperature to a predetermined value is determined every morning (step S22). Every time 2 hours expires, the developing ability is corrected. Specifically, after the rise of the fixing temperature to the predetermined value, the copier 12 is operated in a free run mode over a period of time associated with twenty copies in order to reduce the irregularity in the conditions of the drum 12 (step S23). This free-run mode operation is executed over 30 seconds with the entire eraser 18 being turned on and with the lamp 16*a* being turned off. Then, the density is sensed as to the reference density pattern 26 in an ordinary P sensor mode to thereby determine the developing ability of the developing device 5, in the same manner as when the reference value is set as stated previously (step S24). Again, whether or not the voltage representative of the sensed density is higher than 0.4 V and lower than 0.6 V is determined to see if the developing ability is stable (step S25). If the answer of the step S25 is YES, the program advances to a step S26. If otherwise, i.e., if the voltage is greatly deviated from the predetermined range, the correction is prolonged to the next day or the reference value for correction is shifted. In any case, the toner is automatically supplied or consumed to control the actual voltage to the target value of 0.5 V plus or minus 0.1 V.

In the step S26, a free-run mode operation is executed over substantially one full rotation of the drum 12. Then, a mean value of reference voltages Vsg' of the P sensor 24 is determined (step S27). This is followed by a step S28 for adding 30 v, or one half of a notch, to 50 V which is the reference bias voltage, whereby a bias voltage of 80 V is applied as a bias voltage for development associated with the light pattern 28 (one of variable factors dictating the developing ability) (step S28). In response to the output of the P sensor 24, a voltage V'sl representative of the density of the toner image of the light pattern, or background pattern, 28 is detected on the basis of the mean value of the input data obtained from the hundred divided portions (step S29). The ratio of the detected voltage V'sl to the voltage V'sg previously detected in the step S27, i.e., V'sl/V'sg is compared with the reference ratio Vsl/Vsg (step S30). When the ratio V'sl/V'sg is smaller than the ratio Vsl/Vsg, meaning a shift of the entire image to the high density side, a feed-back by about one notch is effected to the voltage to be fed to the lamp 16*a*, the bias voltage to be applied to the developing sleeve 20*d*, the current to be fed to the charger 14, or similar variable factor associated with the developing ability. This corresponds to a shift of one step having any suitable width and effected within the range of one notch relative to the initial value. As FIG. 5 indicates, in the illustrative embodiment, the above-mentioned one notch of feedback is effected to the quantity of light (lamp voltage Vl) in order to reduce the amount of change on an image as far as possible, i.e., the lamp voltage Vl is increased by about 1 V to about 3 V at a time (step 31). The increment of the lamp voltage Vl is shown as being 2 V by way of example. It is noteworthy that the correction is effected only by one notch at each time of detection for the purpose of preventing the correction from running away. However, since the lamp voltage Vl has a certain upper limit due to the standards, it may be replaced with the bias voltage for development, charging current or similar factor on reaching its upper limit. Hence, the correction width is not limited in practice. In this embodiment, assuming that the upper limit of the lamp voltage Vl is 80 V, whether or not the lamp voltage Vl has reached 80 V as a result of the correction is determined (step S32). If the answer of the step S32 is YES, the subject of the correction is switched over from the lamp voltage Vl to the bias voltage, i.e., the reference bias voltage Vb is increased by 60 V (step S33). More specifically, the increment of 60 V of the bias voltage or the decrement of 8% of the charging current in terms of the total current each corresponds to one notch. The procedure for switching over the subject of the correction as stated above is disclosed the previously stated Japanese Patent Laid-Open Publication Nos. 61-128269 and 62-280871, for example. The corrected values will be sequentially updated thereafter as new developing conditions and the initial values for the next correction, thereby producing developed images the background of which is free from contamination. For example, assuming that the background potential of the drum 12 has been shifted to the dark side, the lamp voltage Vl or the like will be substantially corrected to the light side. The developing ability is, therefore, variably controlled with the variation in background density being taken into account. This is successful in minimizing the contamination on the background of an image, i.e., in producing an image whose density accurately matches the selected image notch.

Figure 4:
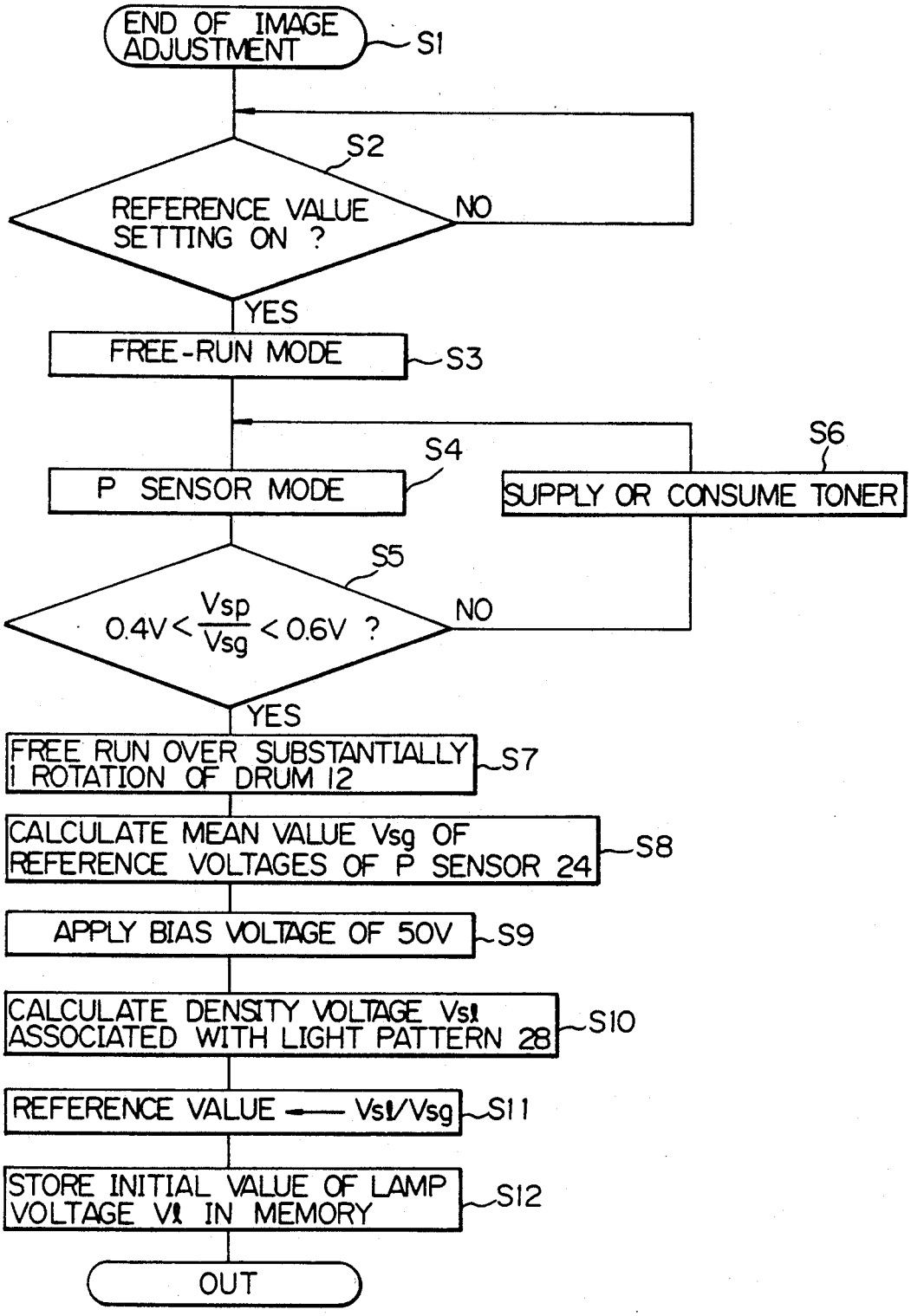
FIGS. 4 and 5 are flowcharts demonstrating specific control operations in accordance with a first embodiment of the present invention.
Figure 5:
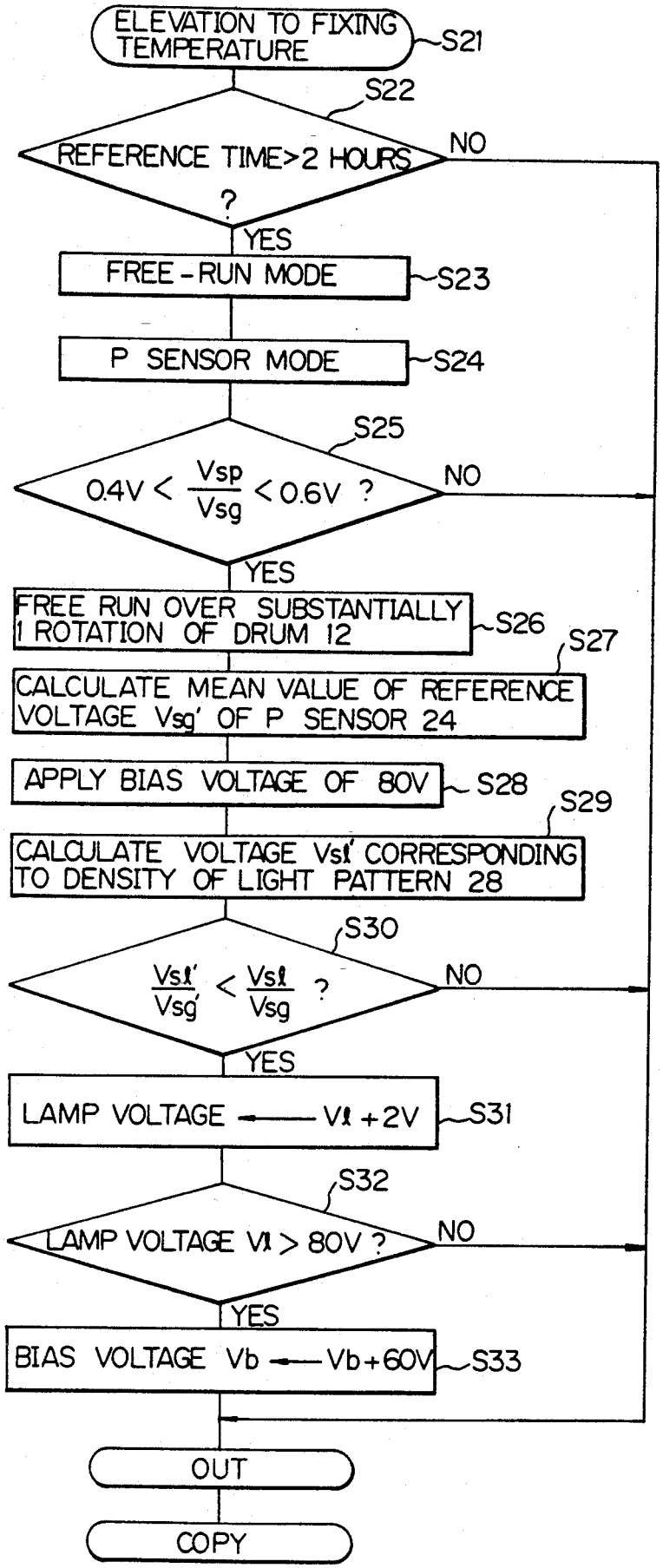
Figure 6:
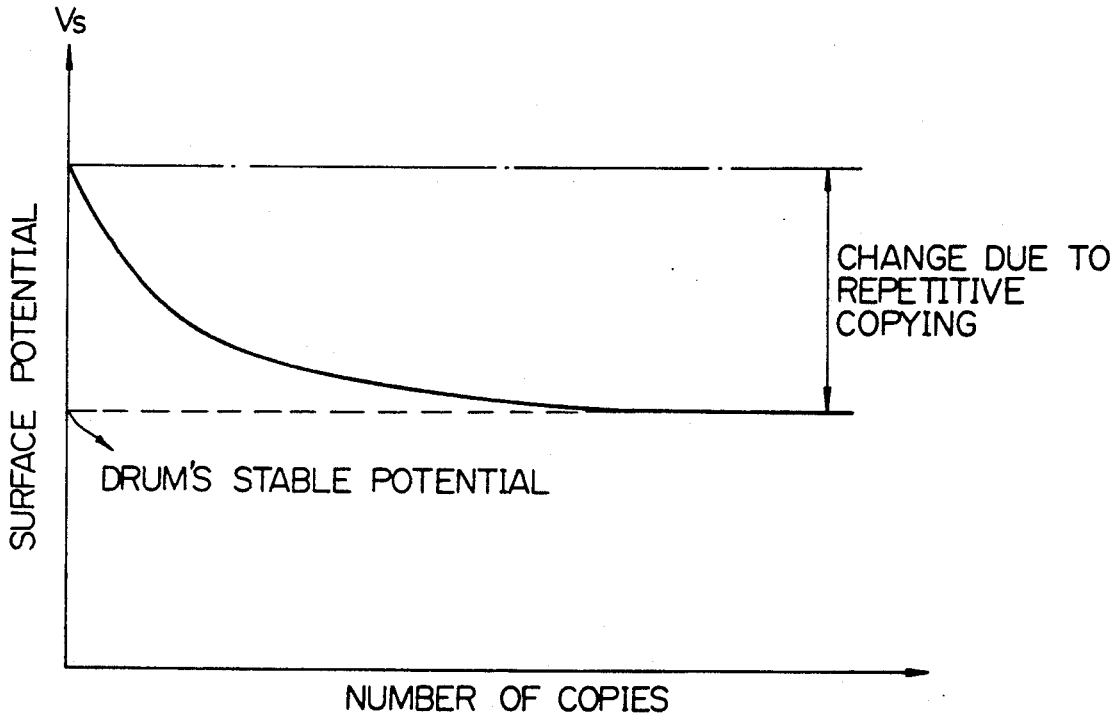
FIG. 6 is a graph showing a variation in surface potential ascribable to the repetitive copying operation.
Figure 7:
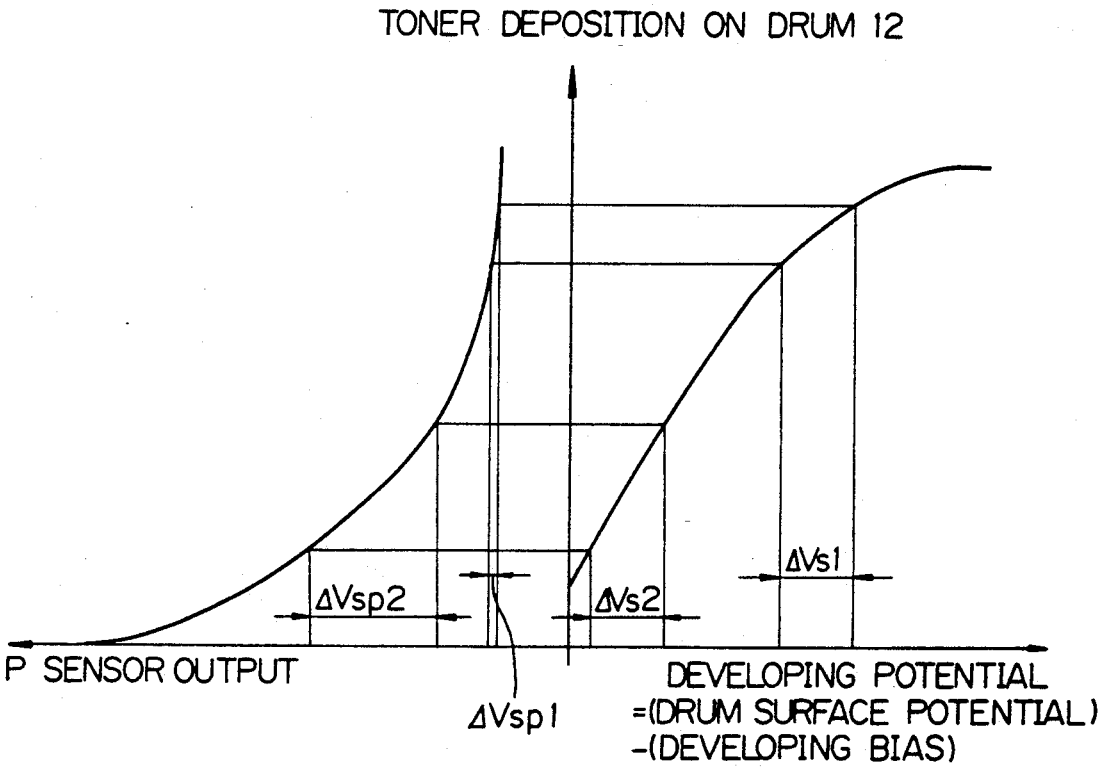
FIG. 7 is a graph representative of a relationship between the output of an image density sensor (P sensor) and developing potential and the amount of toner deposition on a photoconductive element.

In FIGS. 4 and 5, the free-run mode operation executed in the steps S3 and S23 is to stabilize the charge retaining ability of the drum 12. Why such stabilization is necessary will be described. As shown in FIG. 6, the surface potential of the drum 12 sequentially varies as the copying cycle is repeated. Such a variation depends on the material and the degree of deterioration of the drum 12. FIG. 7 indicates the relationship of the developing potential, the amount of toner deposition on the drum 12, and the output of the P sensor 24 to each other. The developing potential is expressed as (surface potential of drum 12)− (bias voltage for development). As shown in FIG. 7, so far as the density control associated with the reference density pattern 26 or similar high density image is concerned, the variation $\Delta Vsp_1$ in the output of the P sensor 24 is negligibly small, compared to the variation $\Delta Vs_1$ in the developing potential ascribable to the drum 12. However, when it comes to the light pattern 28 or similar low density image, the variation in the output of the P sensor 24 is noticeable as indicated by $\Delta Vsp_2$ when the developing potential undergoes a variation of $\Delta Vs_2$ ($=\Delta Vs_1$). Detecting the background density in such a condition would result in inaccurate detection or in runaway. This is because the surface potential or charge retaining ability of the drum 12 and, therefore, the developing potential is not stable. To stabilize the developing potential, the bias voltage for development may be varied stepwise, as known in the art. This kind of scheme, however, simply suppresses the variation in developing potential at a certain by approximation and, therefore, entails substantial irregularity as to whether or not the drum potential is stable. This is why the illustrative embodiment stabilizes the drum 12 by the free-run mode operation. Specifically, while the charger 14 is ON, the lamp 16*a* is OFF, the exposing device 16 is OFF, the eraser 18 is ON, and the developing sleeve 20*d* is ON (in rotation), a free-run mode operation is continued over a period of time associated with twenty copies of format A4. This operation stabilizes the surface potential of the drum 12 to the same degree as just after successive copying operations, by fatiguing it due to charge and light and causing the developer to rub thereagainst. The illustrative embodiment forms a pattern image and senses the density thereof in the above conditions, so that the background density is detected in a stable manner.

In FIG. 5, the step S30 shows a decision formula $V'sl/Vsg' < Vsl/Vsg$ for determining whether or not the control over the factor associated with the developing ability or over the toner supply is necessary. Eventually, this decision relies on whether or not a change in background density has occurred. Considering only the background density, therefore, the decision may be made by using a formula $Vsl < V'sl \times \rho$, where $\rho$ is a constant smaller than 1.

Figure 8:
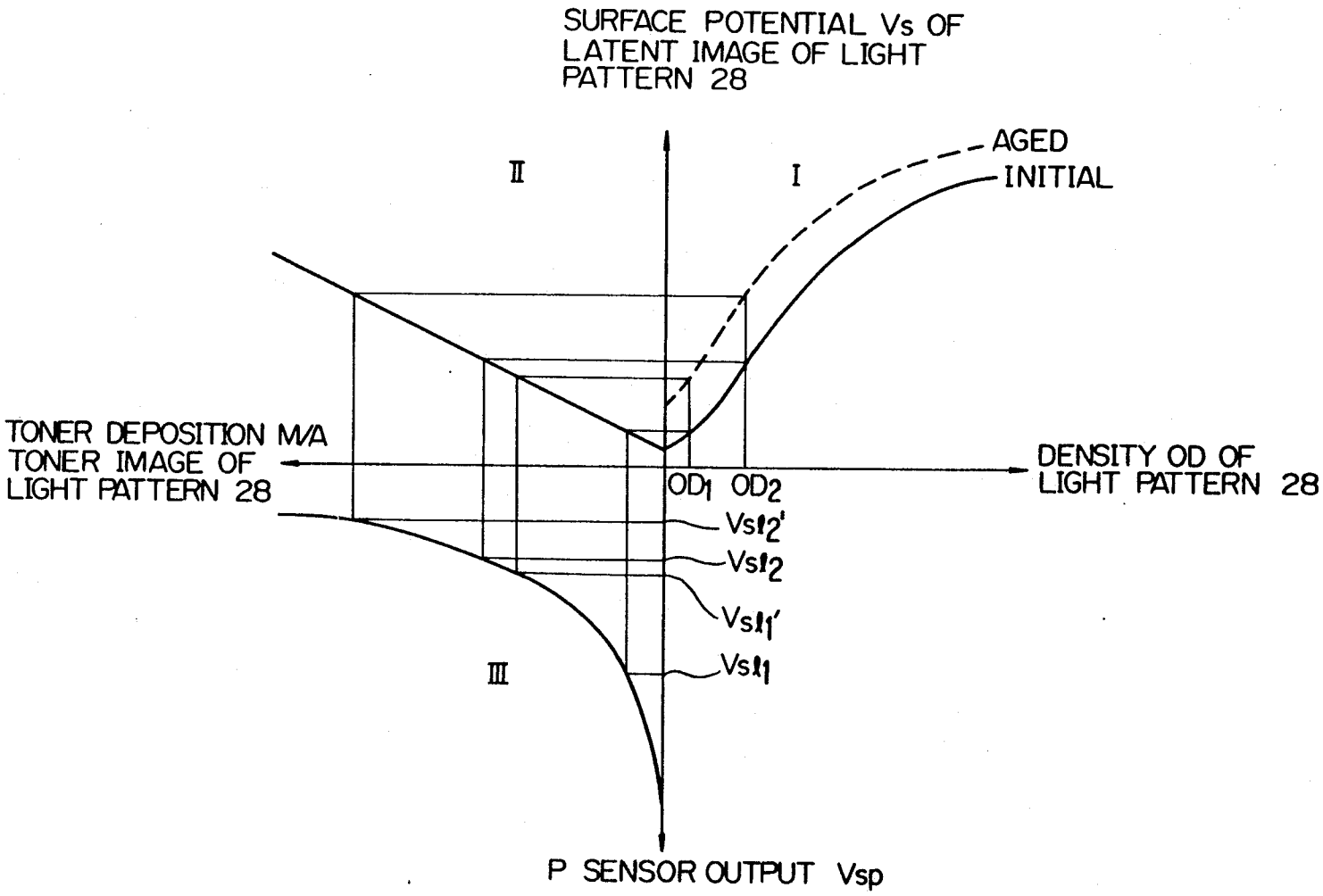
FIGS. 8 and 9 are graphs each showing a relationship of the density of a light pattern, the surface potential of a latent image representative of the light pattern, the amount of toner deposition on a toner image associated with the latent image, and the output of thw image density sensor to each other.

Referring to FIG. 8, the relationship between the density of the light pattern 28 and the output of the P sensor 24 will be described. In the figure, the first quadrant shows a gamma curve between the density OD of the light pattern 28 and the surface potential Vs of the latent image. The second quadrant shows a gamma curve between the surface potential Vs of the latent image of the light pattern 28 and the amount of toner deposition M/A on the associated toner image. Further, the third quadrant shows a gamma curve between the amount of toner deposition M/A and the output Vsp of the P sensor 24. Assume that the light pattern 28 and the drum 12 are in their initial conditions, and that the density OD of the light pattern 28 is $OD_1$. Then, the output Vsp of the P sensor is $Vsl_1$. As the drum 12 deteriorates due to aging, its surface potential Vs is increased with the result that the gamma curve between the density OD and the surface potential Vs is changed as represented by a dashed curve. Consequently, the amount of toner deposition M/A on the toner image of the light pattern 28 whose density is $OD_1$ is increased to in turn lower the output Vsp of the P sensor 24 to V'sl. However, the light pattern 28 whose density is low is susceptible to the machine-by-machine difference and noise such as contamination. When the density OD of the light pattern 28 is increased to $OD_2$ due to the machine-by-machine difference or contamination, the P sensor 24 will produce an output $Vsl_2$ at the initial stage and an output $V'sl_2$ after aging. The resultant gamma curve between the amount of toner deposition M/A and the output Vsp of the P sensor 24 resembles a hyperbola, as shown in the third quadrant. Under this condition, determining whether or not the correction is necessary by using the same constant $\rho$ would render the control itself irregular.

The control may be effected stepwise depending on the value of $\rho$, as also proposed in the art. This conventional implementation executes control by one step when $\rho$ is 0.8, for example, by another step when $\rho$ is 0.6, and by another step when $\rho$ is 0.4. With such an approach, however, the value of $\rho$ decreases even when the charge characteristic of the drum 12 is varied due to aging, because of the gamma characteristic between the density OD of the light pattern 28 and the surface potential Vs of the associated latent image and the gamma characteristic between the amount of toner deposition M/A on the toner image and the output Vsp of the P sensor 24.

Figure 9:
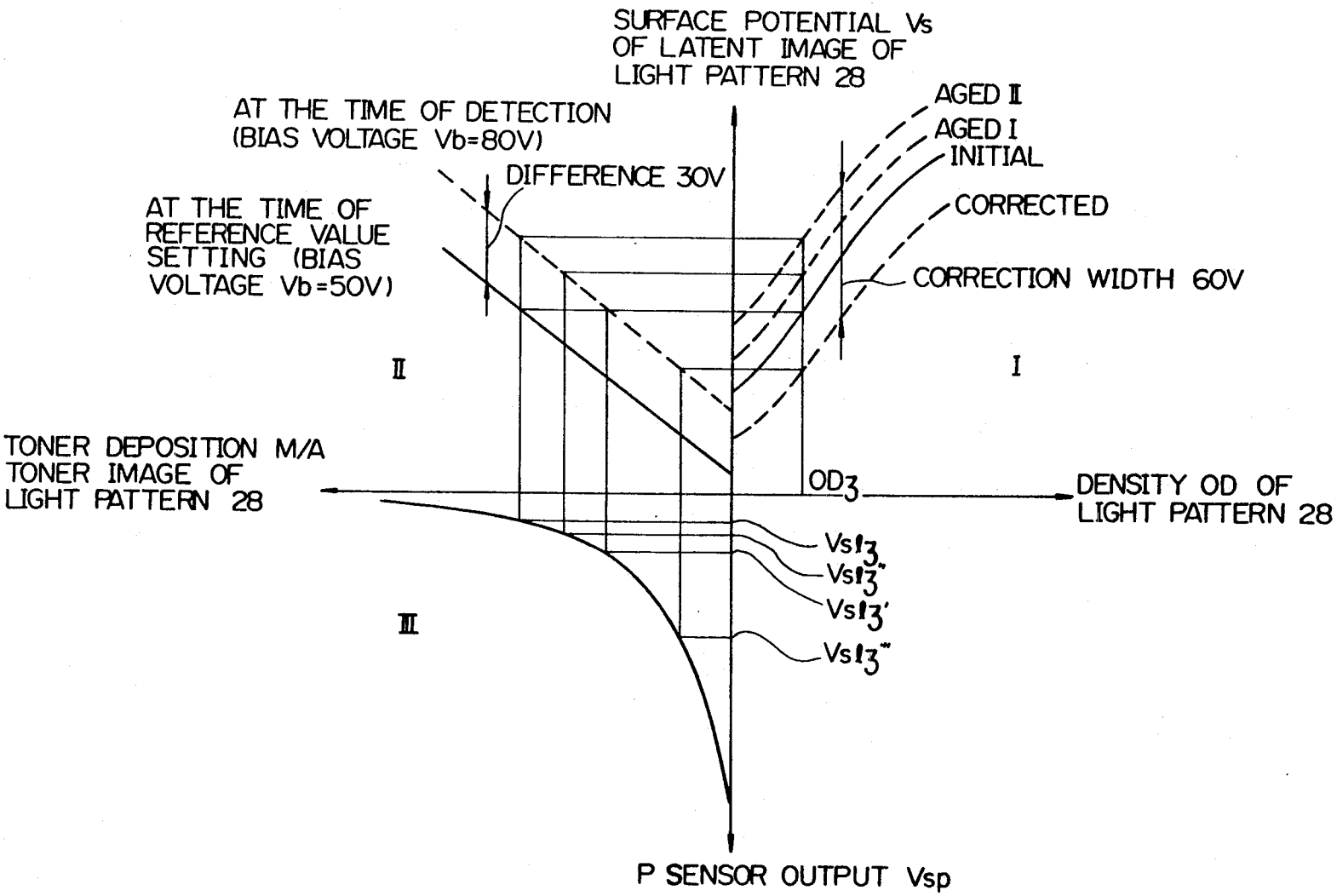

The illustrative embodiment is free from the above-discussed drawback. Specifically, this embodiment does not apply a fixed reference value Vsl associated with the light pattern 28 unconditionally to all the machines. Instead, when a particular machine is delivered to a user or in a similar initial stage, a toner image associated with the light pattern 28 is actually formed on the drum 12 of the machine, and the resultant output of the P sensor 24 is used as an exclusive reference value. Hence, the irregularities in the density of the light pattern 28, the charge characteristic of the drum 12 and the process conditions among machines can be ignored. Further, in the illustrative embodiment, while the bias voltage for development is 50 V in the event when the reference value is set as stated above, the bias voltage for developing the latent image of the light pattern 28 in the event of actual detection, i.e., after aging is increased to 80 V (=50 V+30 V). FIG. 9 shows a gamma characteristic between the surface potential Vs of the drum 12 associated with the light pattern 28 and the amount of toner deposition M/S obtained when the reference value is set and a gamma characteristic between the same which holds at the time of detection. In FIG. 9, a solid and a dashed curve are derived from the bias voltages of 50 V and 80 V, respectively. The two gamma characteristics are represented by two parallel lines. The extra 30 V is one half of the correction width which is 60 V and available with the potential of a latent image. Specifically, FIG. 9 showns in the first quadrant solid curve representative of the gamma characteristic between the initial pattern density OD and the associated surface potential Vs, dashed curves respectively representative of the gamma characteristics between OD and Vs particular to successive aged states I and II of the drum 12, and a dashed curve representative of the gamma characteristic resulted from the correction of the voltage of the lamp voltage. Table 1 shown below lists the variation in the output Vsp of the P sensor 24 and the variation in the surface potential Vs of the latent image of the light pattern 28, in relation to the initial state, aged state I, aged state II, and corrected state.

TABLE 1

| | P SENSOR 24 OUTPUT Vs | SURFACE POTENTIAL Vs OF LATENT IMAGE OF LIGHT PATTERN 28 | CONTROL |
|---|---|---|---|
| 1. REFERENCE VALUE SETTING | $Vsl_3$ | 100 V ASSUMED | |
| 2. DETECTION (INITIAL) | $Vsl_3'$ | 100 V | |
| 3. DETECTION (AGED I) | $Vsl_3''$ | — | |
| 4. DETECTION (AGED II) | $Vsl_3$ | APPROX. 130 V | CORRECTION BY 60 V |
| 5. DETECTION (CORRECTED) | $Vsl_3'''$ | APPROX. 70 V | |

Figure 10:
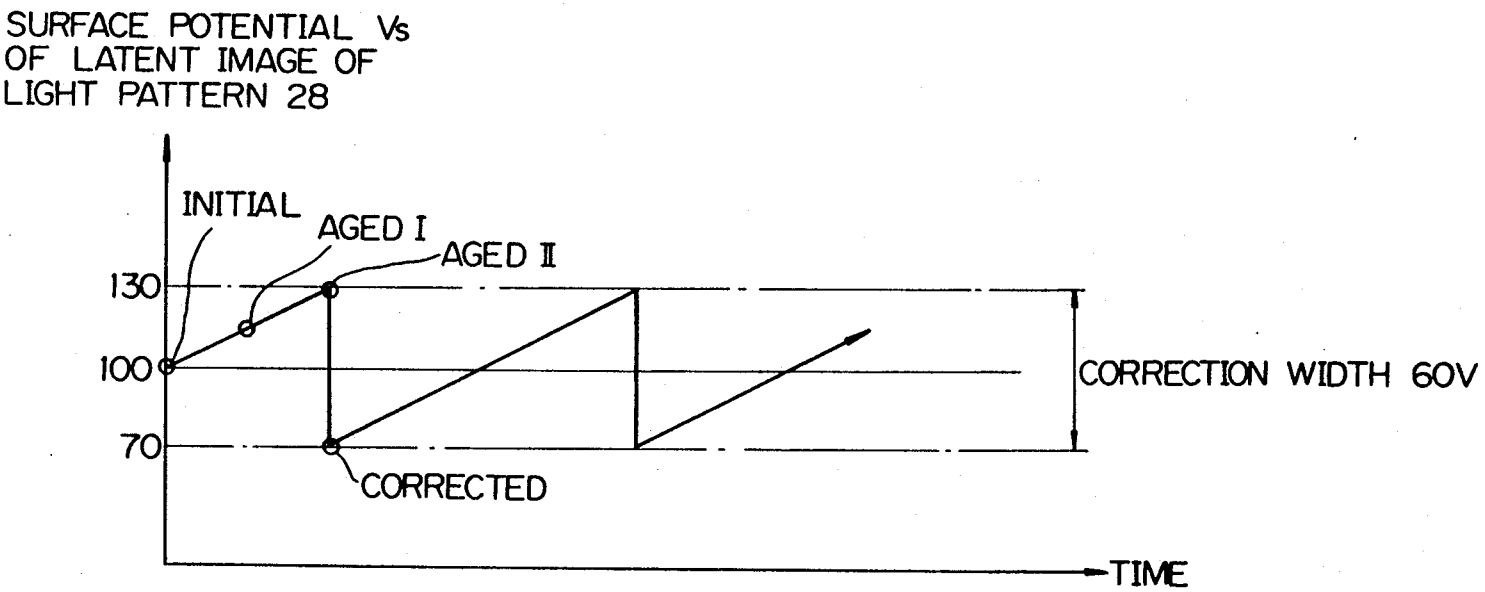
FIG. 10 is a graph showing a variation in the surface potential of the light pattern latent image due to aging.

When the drum 12 is deteriorated from the above stage 2 (initial) to the stage 4 (aged II) via the stage 3 (aged I), the surface potential Vs of the latent image of the light pattern 28 becomes equal to the reference value. Then, it is determined that correction is necessary, and the voltage to the lamp 16*a* is corrected by 2 V corresponding to the surface potential of 60 V. FIG. 10 indicates such a variation of the surface potential Vs with respect to time. As shown, the bias voltage at the time of detection is made higher than the bias voltage at the time of setting of the reference value by one half of the correction width of 60 V, i.e. by 30 V. This is successful in stably confining the image potential in the range of one half of the correction width (60 V) the center value of which is the initial image potential (assumed to be 100 V). It is to be noted that the increment of the bias voltage is not limited to one half of the correction width and may be suitably selected.

Although the light pattern 28 has been shown and described as being located at the trailing end of the glass platen 22, it is omissible when it comes to an automatic density mode. Specifically, as shown in FIG. 1, a document density sensor 30 is movable along with the lamp 16*a*. When the density of the leading end of a document is presumed to be substantially the same as the background density as determined by the document density sensor 30, the background of the leading end of the document may be illuminated in place of the light pattern 28. Using the background of a document itself as stated will eliminate the strict conditions as to the position and other factors which are particular to the light pattern 28.

A second embodiment of the image density control method in accordance with the present invention will be described. This embodiment is concerned with a particular case wherein a user desires characters or similar images to appear more black and thicker on copies, i.e., copies which entirely appear darker than usual copies. In such a case, since a greater amount of toner will deposit on the drum 12, the sensing ability of the P sensor 24 tends to fall and, therefore, the control tends to shift to the dark side as a whole. Then, the first embodiment would cause the background to be contaminated frequently, as described hereinafter with reference to FIG. 11.

Figure 11:
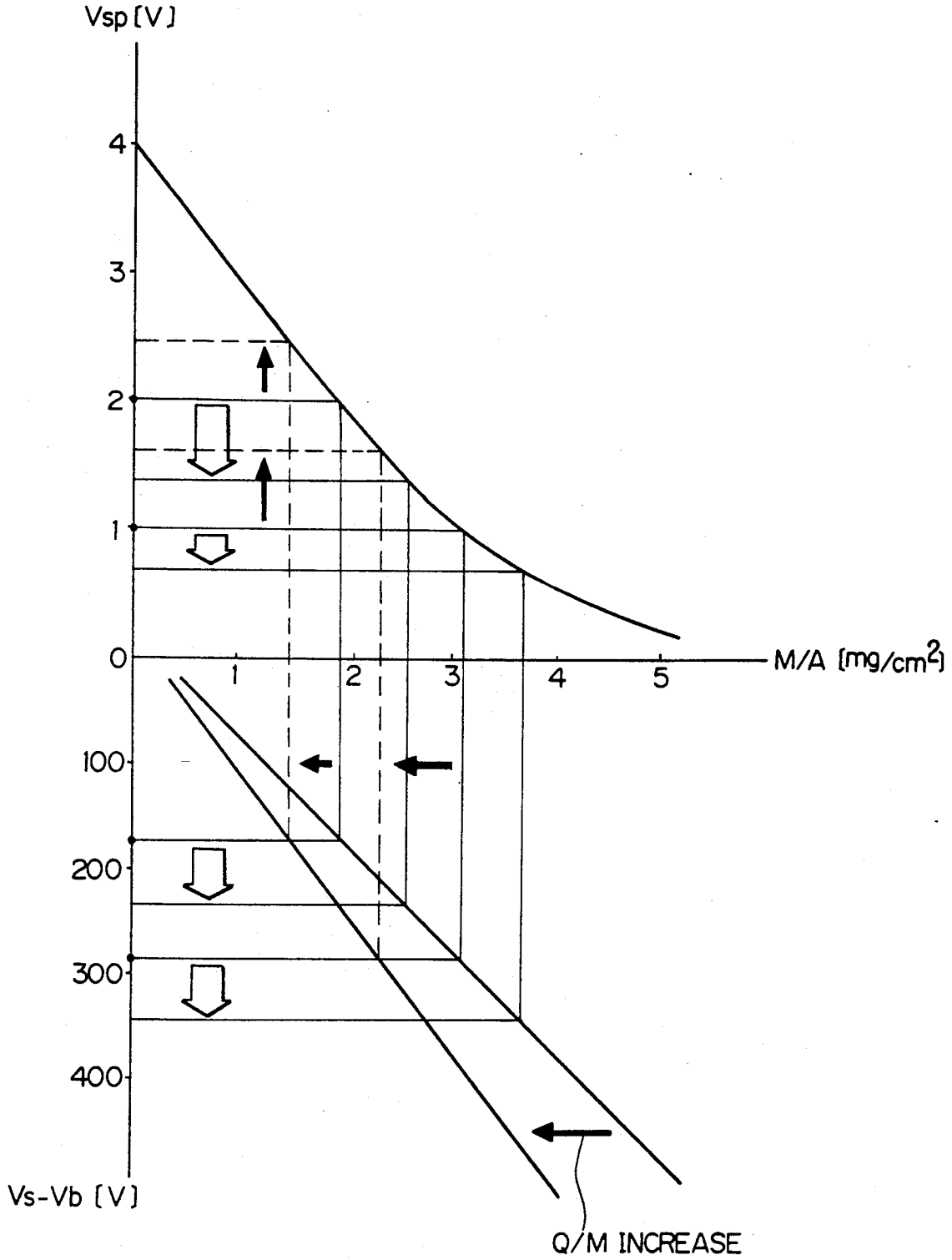
FIG. 11 is a graph representative of a relationship between the output of the image density sensor and developing potential and the amount of toner deposition of the toner image of the light pattern particular to a second embodiment of the present invention.

In the lamp voltage Vl detecting system of the first embodiment, the target voltage Vs (=Vsl) is 2 V when Vs−Vb shown in FIG. 11 is 175 V and the amount of toner deposition M/A is 0.2 mg/cm$^2$. Under this condition, when the potential associated with the background is increased by 60 V (indicated by a blank arrow in FIG. 11), the output Vsp of the P sensor 24 is lowered by 0.6/60 V. On the other hand, when the toner concentration is decreased and Q/M is increased (indicated by a solid arrow) due to, for example, the consumption of a large area, the output Vsp of the P sensor 24 is increased by 0.45 V/2.5 μc/g. In contrast, when a higher density is set up to the user's taste, the output Vsp (=Vsl) of the sensor 24 is 1 V for Vs−Vb=285 V and the amount of toner deposition M/S=0.31 mg/cm$^2$. The toner Q/M becomes irregular on the increase of the potential corresponding to the background by 60 V, as is the case with usual setting. The sensitivity is 0.3 V/60 V when the background potential is increased by 60 V or 0.60 V/2.5 μc/g when the Q/M is increased, as listed in Table 2 below.

TABLE 2

| CHANGE IN P SENSOR 24 | INCREASE IN BACKGROUND BY 60 V | INCREASE IN Q/M |
|---|---|---|
| STANDARD | 0.6 V | 0.45 V |
| DARKER | 0.3 V | 0.60 V |

Therefore, when the lamp voltage Vl, for example, is to be manipulated to render the entire image lighter, the amount of change associated with the darker setting is substantially one half of the amount of change associated with the standard setting, as indicated by blank arrows. Conversely, when an image is determined to be light due to irregularity or the like and is to be entirely darkened, the former is about 1.5 times greater than the latter, as indicated by solid arrows. In the case of darker setting, therefore, the control tends to shift more and more to the dark side.

Figure 12:
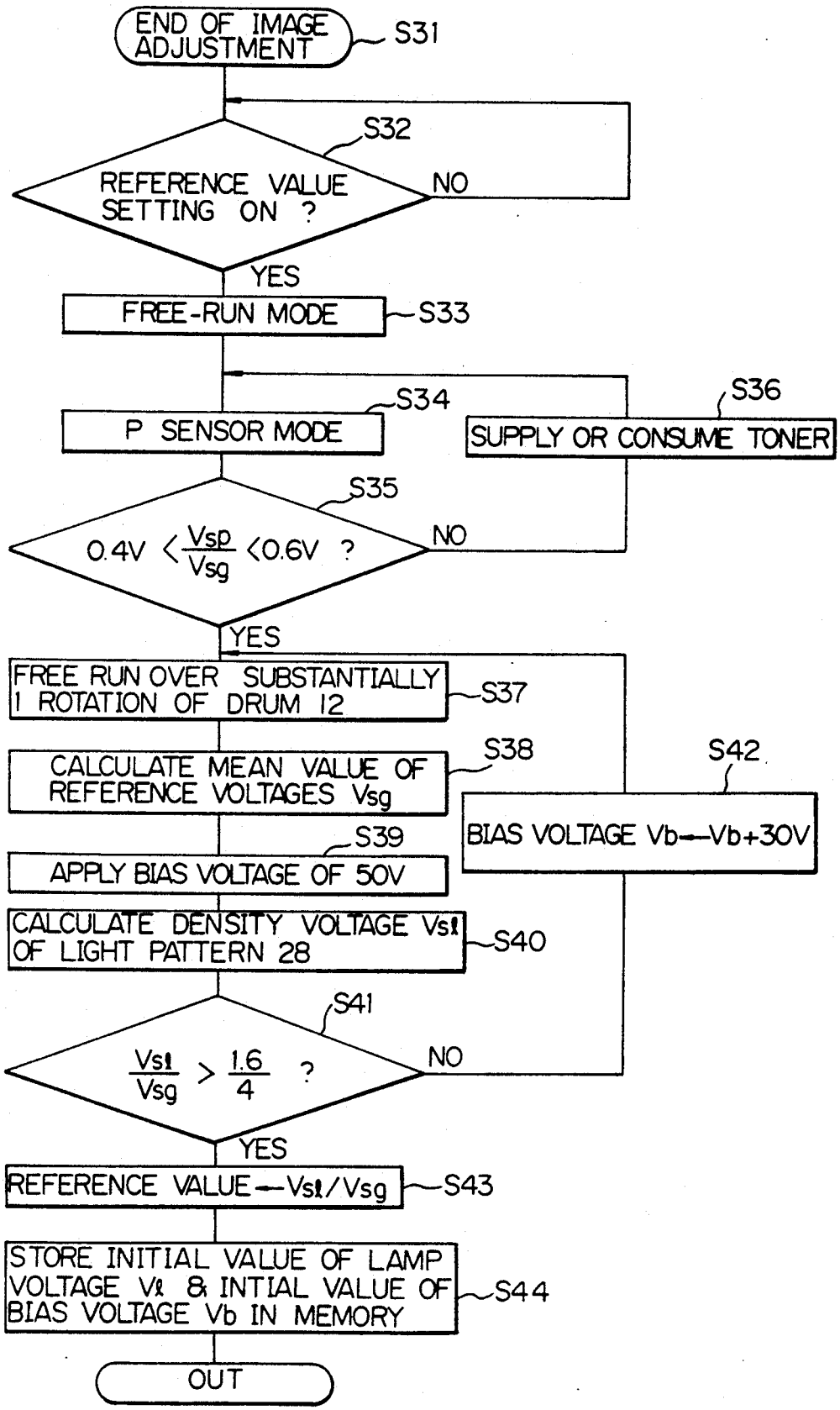
FIG. 12 is a flowchart demonstrating a specific operation in accordance with the second embodiment.

In the light of the above, the alternative embodiment executes control as demonstrated in FIG. 12. This embodiment shares the same basic control principle as the first embodiment. At the time of image adjustment by a serviceman, the lamp 16*a* of the scanner moved to immediately below the light pattern 28 is turned on with the fourth notch and successive notches being sequentially selected. The resultant latent image of the light pattern 28 formed on the drum 12 is developed by a bias voltage of 50 V (step S39) to form a toner image over substantially the entire circumference of the drum 12. Then, in response to the output of the P sensor 24, the density of the toner image is determined as the voltage Vsl (target being 2 V) representative of the density of the light pattern 28 on the basis of data of the hundred divided portions (step S40). If the calculated ratio Vsl/Vsg is smaller than 1.6/4 as distinguished from 2/4 (step S41), the above procedure is executed again from the fourth notch by increasing the bias voltage by 30 V, i.e., to 80 V. When the ratio Vsl/Vsg becomes greater than 1.6/4 after such a repetitive sequence, the detection of the reference values is terminated (step S43). The voltage Vsl representative of the light pattern 28, the reference voltage Vsg of the P sensor 24, the ratio Vsl/Vsg, the bias voltage Vb and the lamp voltage Vl obtained at this instant are written to a memory as reference values (step S44). Of course, the bias voltage Vb at the time of image density correction is incremented by +30 V.

Figure 13:
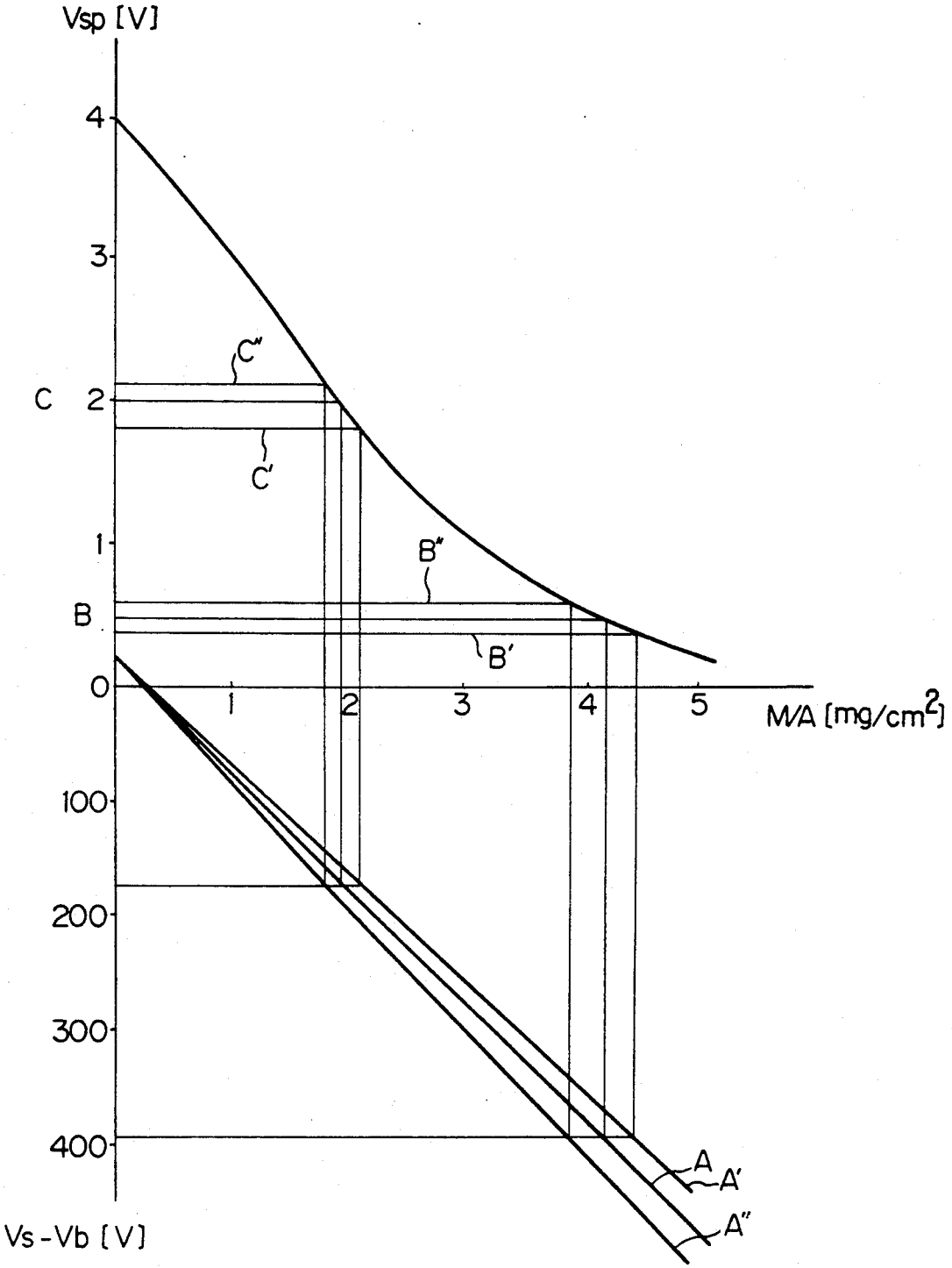
FIG. 13 is a graph showing a relationship between the output of the image density sensor and developing potential and the amount of toner deposition of the toner image of the light pattern particular to a third embodiment of the present invention.
Figure 14:
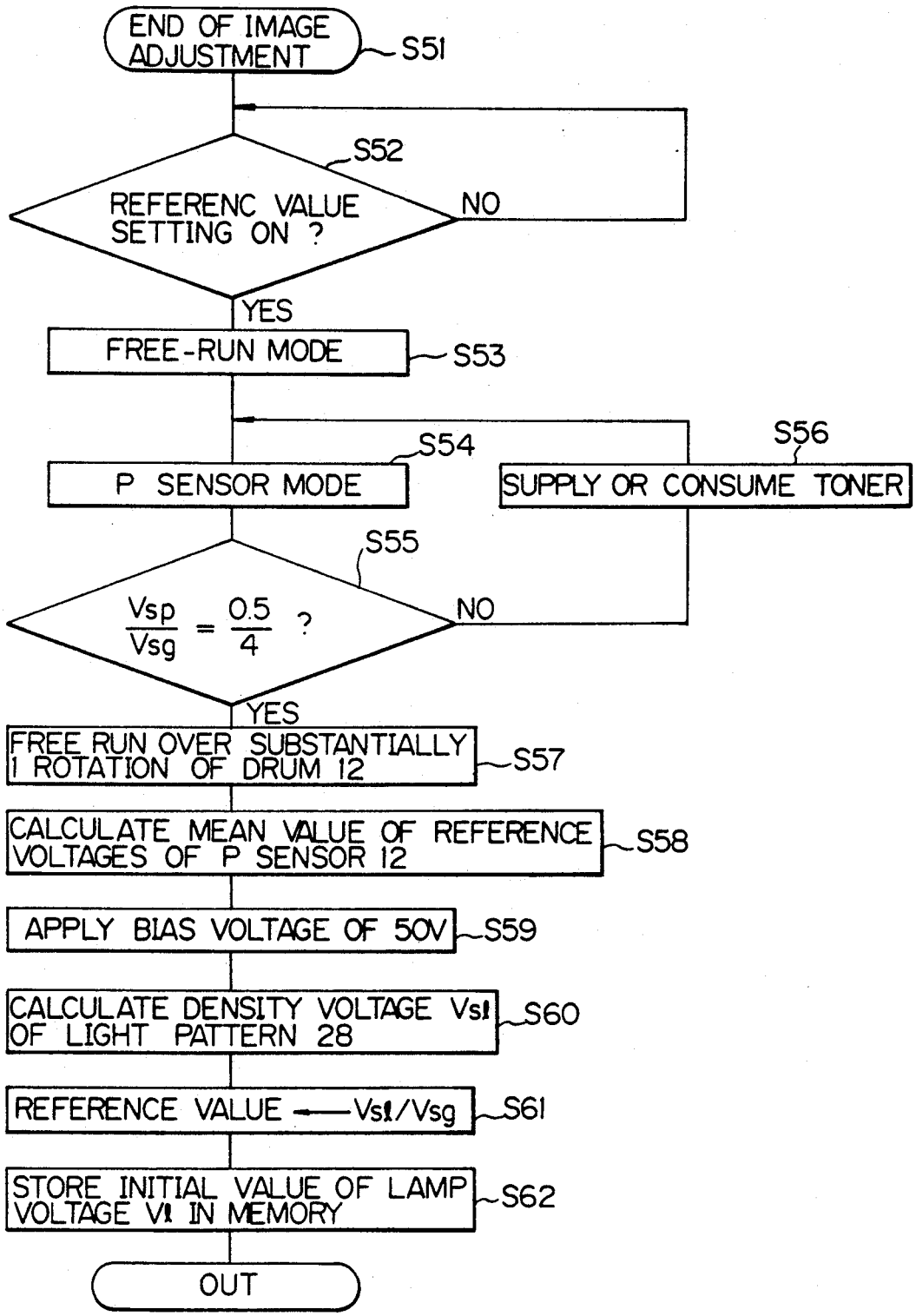
FIGS. 14 and 15 are flowcharts showing a specific operation of the third embodiment.

A reference will be made to FIGS. 13 to 15 for describing a third embodiment of the image density control method in accordance with the present invention. This embodiment pays attention to the fact that the developing ability of the developing device changes. For example, the development gamma characteristic depends on the toner concentration which will be low just after the reproduction of a large black image and will be high just after the supply of toner. The resultant difference in gamma characteristic obstructs accurate detection in relation to the toner image representative of the light pattern 28. FIG. 13 shows a relationship between the output Vsp of the P sensor 24 and the amount of toner deposition M/A on the toner image of the light pattern 28 together with the development gamma characteristic. As shown, while the developing ability is controlled in response to the output of the P sensor 24, the control is effected with Vsp/Vsg=0.5/4 being selected as the center value (B, FIG. 13). This center value corresponds to the center value of the gamma characteristic which is indicated by A in the figure. At this instant, the reference value for the detection of the lamp voltage Vl is read, Vsl is 2 V and this is the center value as indicated by C. Hence, Vsp (=Vsl) is 2 V for Vs−Vb=175 V and the amount of toner deposition M/A on the drum 12 of 0.2 mg/cm$^2$.

However, the condition represented by B, A and C as stated above is rarely occurs. Usually, when the developing ability is sensed by the P sensor 24 at the time of detection of the lamp voltage Vl, Vsp/Vsg is greater or smaller than 0.5/4. For example, when the toner density is low such as just after the production of a great amount of copies or just before the supply of toner, the center values B, A and C will be replaced with values B', A' and C', respectively. FIG. 13 shows a specific condition wherein the output Vsp of the P sensor 24 is increased to 0.45 V/2.5 μc/g. Specifically, Vsp/Vsg is 0.4/4 so that the reference values are shifted to the values associated with Vsl/Vsg=1.8/4. Conversely, when the toner density is high and Q/M is low such as just after the supply of toner, the center values B, A and C will be shifted to B", A" and C", respectively. FIG. 13 indicates a specific case wherein the output Vsp of the P sensor is lowered by 0.6 V/60 V, i.e., the reference values are shifted to the values associated with Vsl/Vsg=2.1/4. In this manner, the reference values vary with the output of the P sensor 24. It is necessary, therefore, to shift the ratio Vsl/Vsg along with the ratio Vsp/Vsg. Experiments conducted with the illustrative embodiment proved that for a change in the ratio Vsp/Vsg by 0.1/4 more accurate detection is achievable by shifting the ratio Vsl/Vsg by 0.15/4.

Figure 15:
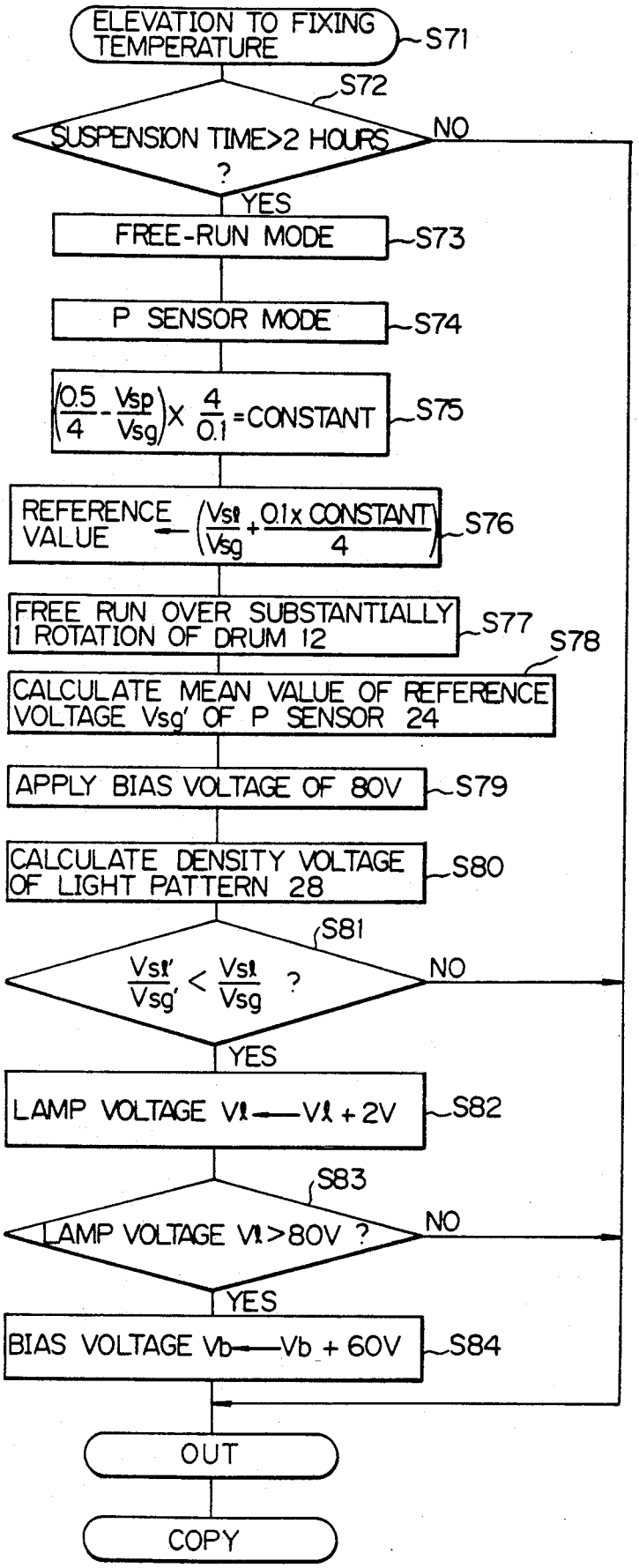

In FIG. 15, steps S75 and S76 are representative of the processing for shifting the reference value as stated above. However, when the reference value is read for the first time, a value under the condition wherein the developing ability is fully controlled, i.e., Vsp/Vsg=0.5/4 or the value of Vsp/Vsg has to be read to correct the reference value. For example, when Vsp/Vsg is 0.45/4, the reference value has to be lowered by 0.075/4 and then written to the memory.

The present invention achieves various advantages as enumerated below.

(1) A background pattern whose density is substantially the same as the background density of a document, i.e., a light pattern is illuminated to electrostatically form a latent image thereof on a photoconductive element. The latent image is developed by a toner, and the density of the resultant toner image is optically sensed by an image density sensor. It is, therefore, possible to detect a change in the background density due to contamination or an increase in background potential, for example. Based on the detected change in background density, a quantity of light for exposure or similar factor associated with the developing ability is corrected, i.e., it is controlled to the light side if the density has been shifted to the dark side. This provides an image with an adequate density matching a selected image notch. Especially, since the detection of the background density and the control for correction are effected after the charge retaining ability of the photoconductive drum has been stabilized, the density of the toner pattern representative of the light pattern can be sensed with accuracy to thereby promote sure correction.

(2) Just after or just before the supply of a toner, the toner concentration of a developer, Q/M and other factors are not stable so that development is apt to become irregular. Should the detection of the background density and the control for correction be executed in such a condition, the results of detection and correction would involve errors. In accordance with the present invention, the detection and correction are performed only under a predetermined condition wherein the developing ability remains stable withbin a particular range, whereby the errors are eliminated.

(3) The toner image of the background pattern or light pattern has a low density and is, therefore, susceptible to machine-by-machine differences and noise such as contamination. In the light of this, the present invention selects a higher bias voltage for development at the time of detection of the toner image of the background pattern than at the time of setting a reference value. The detection, therefore, takes account of contamination due to aging and thereby insures stable control.

(4) The total current to be fed to a charging device, the voltage to be applied to a lamp, the bias voltage for development or similar factor associated with the developing ability is corrected by one step of shift having any desired width within the range of one notch, relative to the initially set value. This is successful in eliminating the runaway of the correction. When the factor which is the subject of correction reaches the maximum variable value, it is replaced with another factor and the values of such factors after the correction are sequentially updated for the next correction. Hence, the correction width is substantially free from limitations and, therefore, enhances adequate correction.

(5) When the optically measured value does not lie in a predetermined range, the bias voltage for development is so shifted as to confine the former in the latter and the reference value of that moment is written to a memory. Therefore, even when a higher density is selected to the user's taste beforehand, the tendency that an image shifts to the dark side is eliminated to prevent the background from being often contaminated.

(6) The reference value for the detection of a background potential is corrected in response to a change in the detected developing ability. This promote further accurate detection of a background density and, therefore, adequate image density control.

Various modifications will become possible for those skilled in the art after receiving the teachings of the present disclosure without departing from the scope thereof.

What is claimed is:

1. An image density control method for an image forming apparatus wherein the toner image of a document image is controlled to a predetermined density in a system wherein a latent image of a reference density pattern is electrostatically formed on a photoconductive element and is developed by a toner-containing two component developer means to form a toner image having an optically sensed density, said method comprising the steps of:

(a) stabilizing the potential of said photoconductive element by causing repetition fluctuation to occur in a free run mode;

(b) electrostatically forming a latent image representative of a background pattern having substantially the same density as the background density of a document on said photoconductive element;

(c) developing said latent image by a predetermined bias to produce a toner image;

(d) sensing the density of said toner image; and (e) comparing the sensed density with a stored reference value and, based on the result of comparison, correcting the amount of exposure or the set condition of developing bias wherein said stored reference value is stored in an initial set mode which consists in:

(f) stabilizing the potential of said photoconductive element by causing repetition fluctuation to occur in a free run mode;

(g) electrostatically forming a latent image representative of a background pattern having substantially the same density as the background density of a document on said photoconductive element;

(h) developing said latent image by a predetermined bias to produce a toner image; and (i) sensing and then storing the density of said toner image.

2. A method as claimed in claim 1, wherein said predetermined developing bias in step (h) is lower than a usual developing bias.

3. A method as claimed in claim 2, wherein said predetermined developing bias in step (c) is half a notch (one half of the correction amount of developing bias) higher than said developing bias in step (h).

4. A method as claimed in claim 1, further comprising the step of, in said initial set mode, selecting a higher developing bias when the sensed density of the toner image is higher than a predetermined value.

* * * * *